United States Patent [19]

Ogaki et al.

[11] 4,159,890

[45] Jul. 3, 1979

[54] PAVING MATERIAL EXTRUSION MOLDING APPARATUS

[75] Inventors: Koji Ogaki, Yokohama; Katsu Hirosawa; Masashi Kaminishi, both of Hiratsuka; Yoshinori Nozawa, Tokyo; Hiroshi Kakuta, Isehara; Akio Aoki, Chigasaki, all of Japan

[73] Assignee: Kabushiki Kaisha Komatsu Seisakusho, Tokyo, Japan

[21] Appl. No.: 858,380

[22] Filed: Dec. 7, 1977

[30] Foreign Application Priority Data

Dec. 9, 1976 [JP] Japan ..... 51/147160
Dec. 9, 1976 [JP] Japan ..... 51/147161
Dec. 9, 1976 [JP] Japan ..... 51/148586

[51] Int. Cl.[2] ..... B28B 13/02

[52] U.S. Cl. ..... 425/59; 404/105; 425/64

[58] Field of Search ..... 425/59, 63–65, 425/432; 404/98, 105; 264/33–34

[56] References Cited

U.S. PATENT DOCUMENTS

| | | | |
|---|---|---|---|
| 2,447,571 | 8/1948 | Ekenstam | 404/98 |
| 2,539,063 | 1/1951 | Ekenstam | 404/98 |
| 2,707,422 | 5/1955 | Canfield | 404/98 |
| 2,818,790 | 1/1958 | Canfield et al. | 404/98 |
| 3,138,079 | 6/1964 | Smith | 404/98 |
| 3,284,867 | 11/1966 | Booth | 425/432 |
| 3,710,695 | 1/1973 | Miller et al. | 404/98 |
| 4,014,633 | 3/1977 | Goughnour | 425/64 |

*Primary Examiner*—Roy Lake
*Assistant Examiner*—John McQuade
*Attorney, Agent, or Firm*—Armstrong, Nikaido, Marmelstein & Kubovcik

[57] ABSTRACT

A paving material extrusion molding apparatus for continuously laying or molding a paving material wherein the paving material supplied into hoppers is conveyed into a molding element by a plurality of screw conveyors, the paving material is compacted or consolidated by screw thrusts equal to the frictional force produced by the dead weight of the extrusion molding apparatus, a reaction force created by the compaction or consolidation is utilized to float off the entire extrusion molding apparatus, and a reaction force created by the conveyance of the paving material being continuously fed serves to move the extrusion molding apparatus along the predetermined path.

13 Claims, 9 Drawing Figures

PAVING MATERIAL EXTRUSION MOLDING APPARATUS

BACKGROUND OF THE INVENTION

1. Field of the Invention

This invention relates to an apparatus for continuously molding and laying structures such as curb stones, ditches or gutters or water channels made from cement and sand mixtures having a fluidity when they are placed and also having a property of setting with lapse of time or thermoplastic materials such as asphalt or resins or sand or aggregates or earth or combination thereof or fluidized clays or other paving material or materials selected in accordance with the purpose thereof.

2. Description of the Prior Art

U.S. Pat. No. 2,707,422 discloses an apparatus employing a single screw conveyor which has been used only for laying structures such as curb stones on roads having a comparatively small difference in transverse and longitudinal dimensions.

This limited use is due to the fact that although materials having a high fluidity can be easily molded into a mass or lump and also can be continuously laid in a wide range, when laying materials having a low fluidity continuously resultant structures tend to have uneven densities and blowholes or cavities therein which have sometimes caused damages originated therefrom and water leakage problems. On the contrary, when the fluidity of the paving materials to be laid or molded is too high, the paving material will not easily stand by itself, and therefore there occurs a workability problem that permits the molding only of structures which are of low height.

A further important background of the present invention resides in that coupled with the food problem today, in countries with little rainfall, particularly in desert regions, a technique for automatically and continuously forming water channels for irrigation for feeding agricultural products, for tree planting and for making green belts has been desired, and so devices for laying a paving material continuously in a wide range is required to secure a required amount of water flow, and in order to increase the laying or molding rate it is required to keep the fluidity of the paving material being laid as low as possible and eliminate the tendency for the formation of blowholes or cavities in resultant structures due to poor fluidity or insufficient compaction and consolidated settlement thereof.

However, there is at the present time no device which can solve these problems and be put to practical application.

SUMMARY AND OBJECTS OF THE INVENTION

The present invention has been contemplated in view of the above-mentioned circumstances, and has for its object to provide a paving material extrusion molding apparatus.

The objects of the present invention are:

It is an object of the present invention to enable a plurality of paving material conveyor means to be combined in compliance with the sectional shape of the paving material to be molded thereby effecting extension of the paving material of a uniform thickness and compaction thereof in a molding means so that a structure of a thin wall thickness and having no defects can be continuously laid or molded.

It is another object to enable the plurality of paving material conveyor means to be combined in compliance with the sectional shape of the paving material to be molded and have a conveying capacity corresponding to the sectional shape thereby effecting extension of the paving material of a uniform thickness and compaction thereof so that a structure having no defects can be continuously laid or molded.

It is still another object to form a lining of the paving material on the surface of a trench which has previously been excavated in a predetermined sectional shape thereby forming a water channel capable of preventing water leaks.

It is a further object to enable a molding means to be replaced by another one depending on the sectional shape of the paved structure to be formed.

It is still a further object to provide a means for introducing the heat of exhaust gas emitted by a prime mover into a molding means for achieving easier separation of the paving material from the boundary surface thereof in the case a thermoplastic material is used as the paving material.

It is another object to hydraulically connect the plurality of conveyor means with one another by means of their respective hydraulic circuits arranged in parallel to one another so that when a shortage of supply of paving material occurs in a part of the structure to be formed the load applied on the conveyor means located in such part is reduced. As a result the total fluid within the hydraulic circuits is reduced so that other conveyor means is inoperative thereby stopping the entire extrusion molding apparatus and preventing the formation of structures with defectives due to poor compaction or consolidated settlement.

Therefor it is still another object to provide wheels capable of being raised and lowered by a linkage mechanism thereby enabling the extrusion molding apparatus to be towed to run freely.

BRIEF DESCRIPTION OF THE DRAWINGS

These and other objects and advantages of the invention will become more fully apparent as the following description is read in conjunction with the drawings wherein.

DETAILED DESCRIPTION OF THE INVENTION

Figure 1:
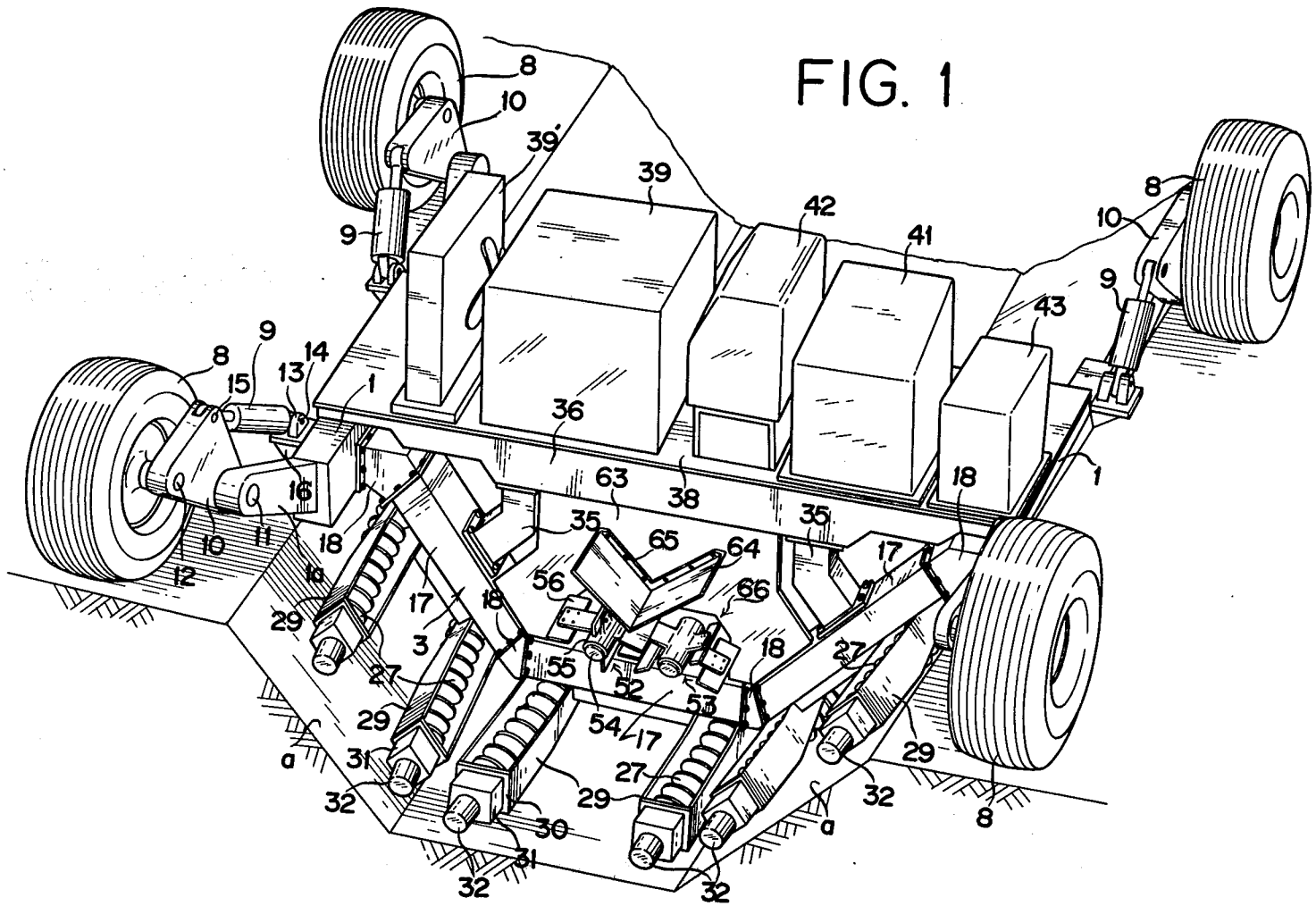
FIG. 1 is a perspective view of a channel forming apparatus of the present invention.
Figure 2:
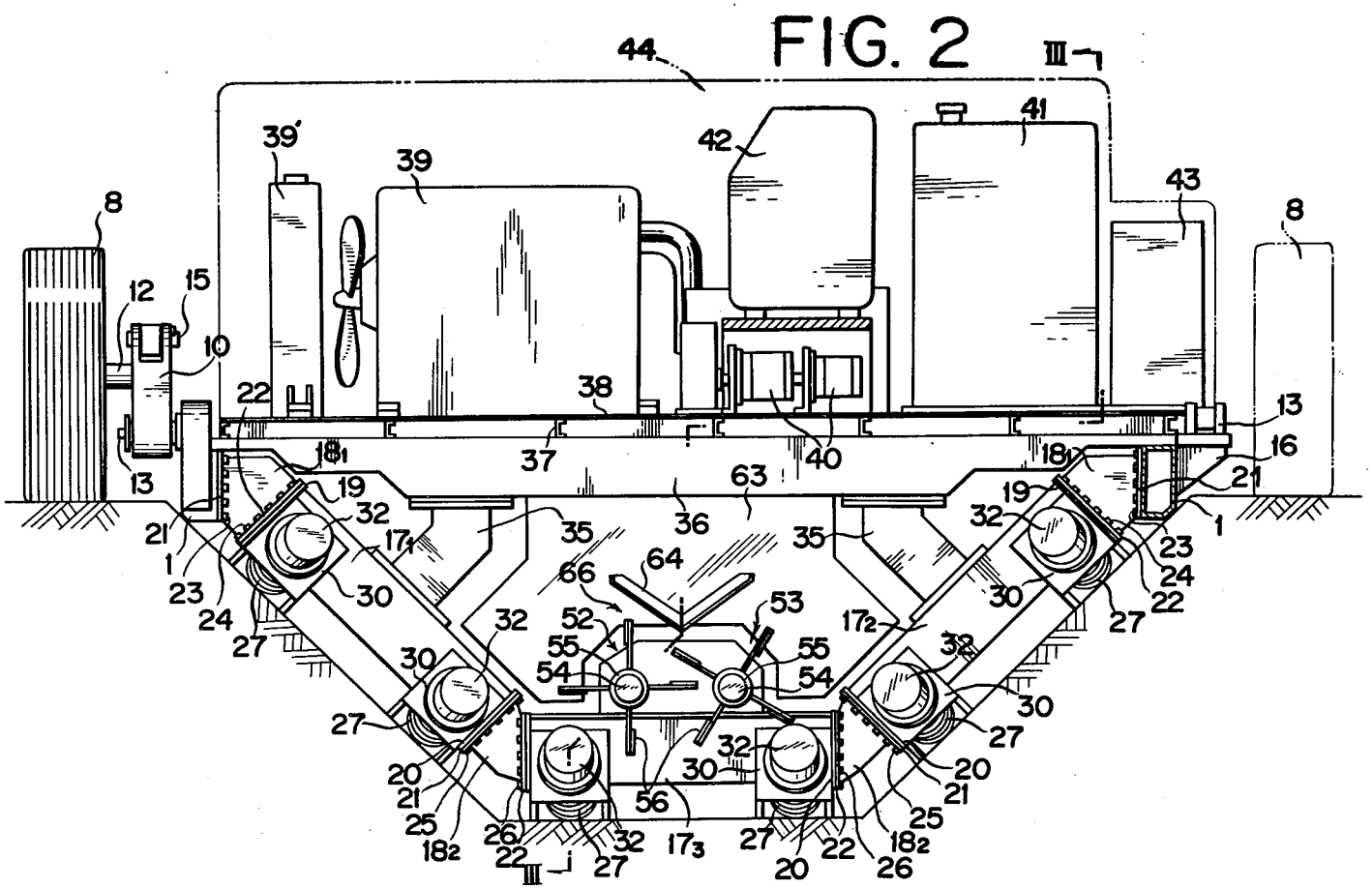
FIG. 2 is a front elevational view of the apparatus shown in FIG. 1.
Figure 3:
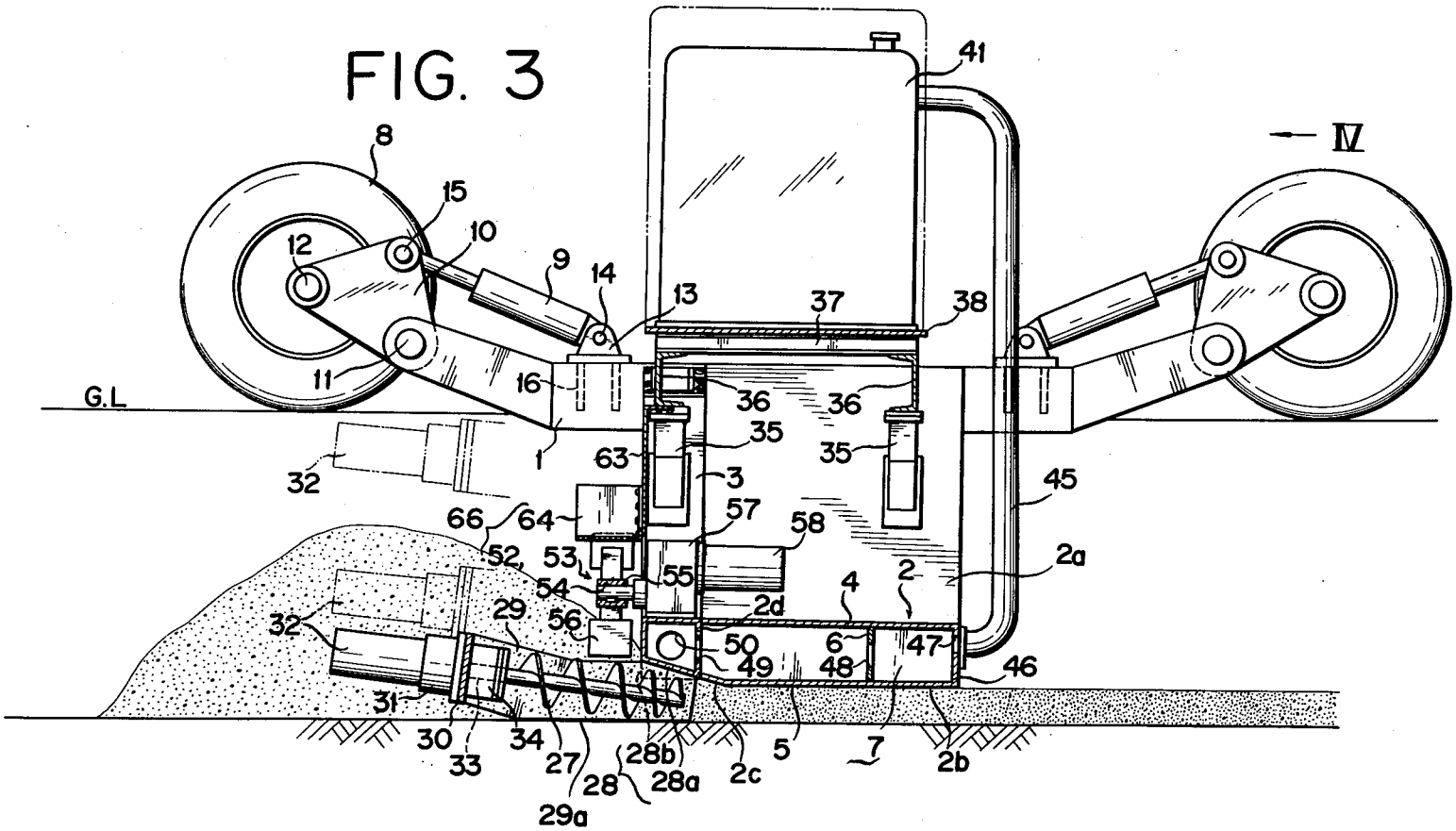
FIG. 3 is a partially cross-sectional view taken along line III—III in FIG. 2.
Figure 4:
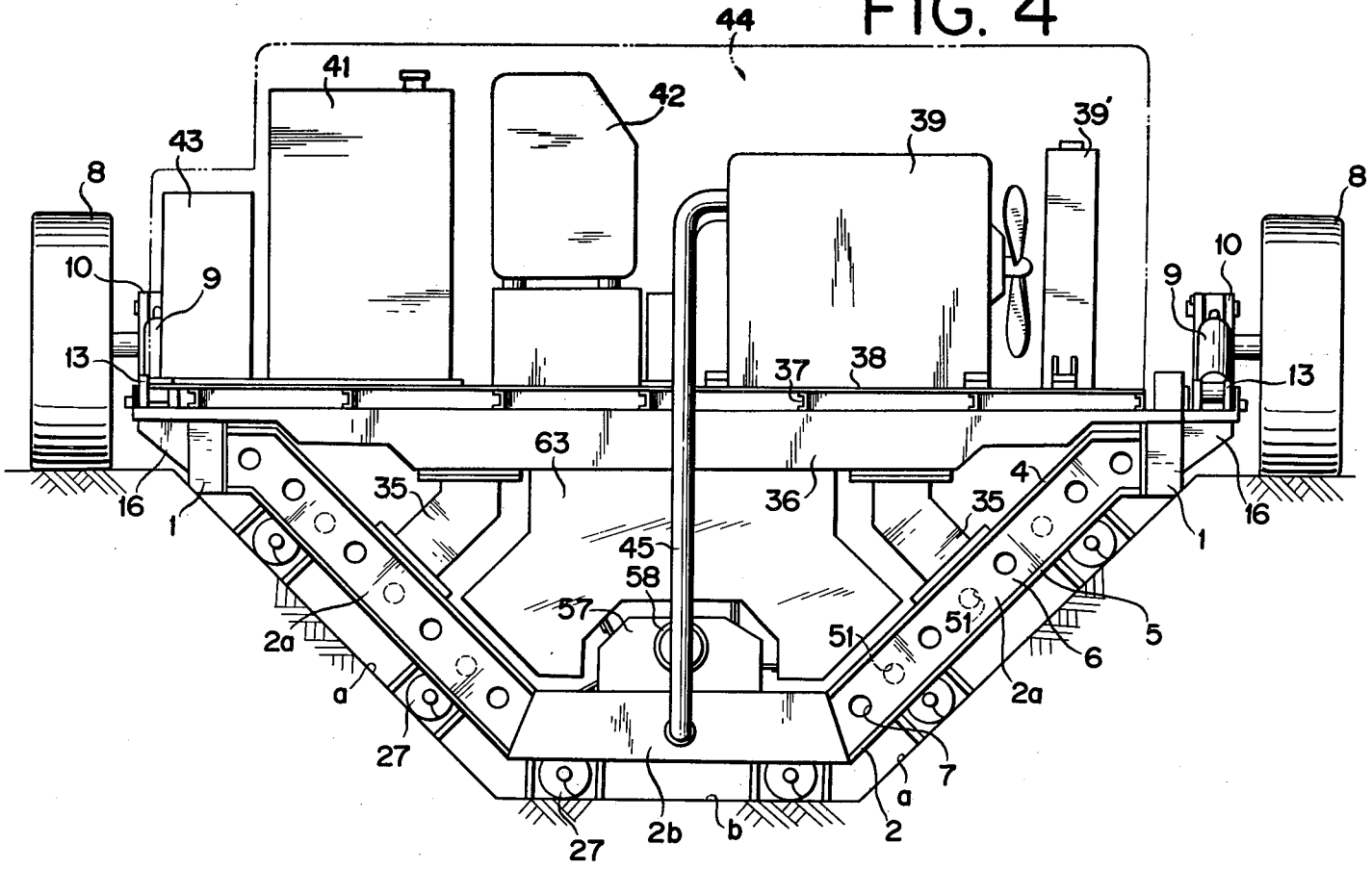
FIG. 4 is a rear elevational view as seen from an arrow IV in FIG. 3.
Figure 5:
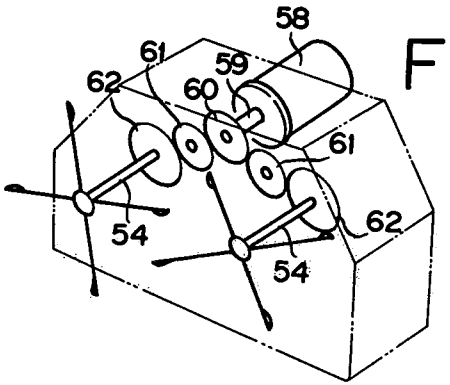
FIG. 5 is a schematical perspective view of a power transmission mechanism employed in the apparatus shown in FIG. 1.

Fixedly secured onto a pair of bodies 1, 1 is a molding member 2 and a mounting cross-bar 3. The molding member 2 has a sectional shape corresponding to that of a water channel provided by inclined members 2*a*, 2*a* which are inclined along inclined inner wall surfaces "a", "a" of the water channel and a central horizontal member 2*b* which is located on and along an inner wall surface "b" of the horizontal bottom thereof.

In the illustrated embodiment of the present invention, both the inclined members 2*a*, 2*a* on both sides and the central horizontal member 2*b* comprise a pair of upper and lower plates 4 and 5 fixedly secured to each other by a rib 6 with a plurality of hollow parts 7 formed therein.

Further, a wheel 8 is mounted through a cylinder 9 and an oscillating arm 10 on each of front and rear projecting members 1*a*, 1*a* of the pair of bodies 1, 1 on the left and right sides so that the wheel can be moved freely in the vertical direction. Stated more specifically, the oscillating arm 10 is pivotally mounted on the front projecting member 1*a* by means of a pin 11, and the wheel 8 is mounted through a support shaft 12 on the oscillating arm 10. Further, the cylinder 9 is pivotally connected between a bracket 13 fixedly secured to the body 1 and the oscillating arm 10 by means of pins 14 and 15. Reference numeral 16 denotes a reinforcing rib.

The above-mentioned cross-bar 3 comprises unit mounting cross-bars 17 connected through brackets 18 so as to block a front opening 2*d* of the molding member 2 along a water channel. Stated more specifically, the unit mounting cross-bar 17 of a box-shaped section has flanges 19 and 20 formed at both ends thereof. Each of the brackets 18 is of a predetermined shape to enable them to be connected along the water channel, and has flanges 21 and 22 formed at both ends thereof. A first bracket $18_1$ is fastened and secured through the flange 21 to each of the bodies 1 by means of bolts 23. First and second unit mounting cross-bars $17_1$ and $17_2$ are fastened and secured, respectively, through the flanges 19 and 22 to each of brackets $18_1$ by means of bolts 24. In this case, the shape of the first brackets $18_1$ is determined so that the first and second unit mounting cross-bars $17_1$ and $17_2$ can be inclined along the inner wall surfaces "a", "a" on both sides of the water channel. A second bracket $18_2$ is fastened and secured through a flange 21 to each of other flanges 20 of the first and second unit mounting cross-bars $17_1$ and $17_2$ by means of bolts 25. A third unit mounting cross-bar $17_3$ is fastened and secured through flanges 19 and 20 to other flanges 22 of the second brackets $18_2$ by means of bolts 26. The shape of the second brackets $18_2$ is determined so that the third unit mounting cross-bar $17_3$ can be laid horizontally along the inner wall surface "b" of the horizontal bottom of the water channel.

Further, a pair of screw conveyors 27 for extrusion molding extend in the direction of movements (in front and in the rear) and are fixedly secured to the above-mentioned unit mounting cross-bars 17. Each of the extrusion molding screw conveyors 27 is accessible opposite to an inlet 2*c* of the molding member 2. Stated more specifically, the unit mounting cross-bars 17 have each a recess 28 formed therein and having an inclined face 28*a* and a pair of parallel faces 28*b*, 28*b*. The rear ends of a pair of longitudinal plates 29, 29 are fixedly secured in parallel with the pair of parallel faces 28*b*, 28*b*. The leading ends of the longitudinal plates 29 extend forwardly in the direction of movements and are fitted with a cover plate 30, respectively. Fixedly secured to the cover plate 30 are a reduction gear 31 and a motor 32 having an output shaft 33 connected to the screw conveyor 27 for extrusion molding which is supported by a bearing 34 between the pair of longitudinal plates 29.

Further, supports 35 are fixedly secured to the first and second unit mounting cross-bars $17_1$ and $17_2$ and the rear ends of the inclined members 2*a*, 2*a* of the molding member 2. Transversely extending and fixedly secured to the supports 35 are transverse members 36. A mounting plate 38 is fixedly secured through channel members 37 to the transverse members 36.

Installed on the mounting plate 38 are an engine 39, a radiator 39', a hydraulic pump 40, a fuel tank 41, a hydraulic fluid reservoir 42 and a battery 43 etc., all of which are covered by a cover 44.

The engine 39 has an exhaust pipe 45 connected to an inlet port 47 of a rear cover plate 46 of the central horizontal member 2*b* of the molding member 2 so that the exhaust gas emitted by the engine can be supplied into the hollow parts 7. The exhaust gas flows through a hole 48 formed in the rib 6, a hole 49 formed in the third unit molding cross-member $17_3$, holes 50 formed in the first, second and third unit molding cross-members $17_1$, $17_2$ and $17_3$ and holes 51 formed in the first and second unit molding cross-bars $17_1$ and $17_2$, and then flows into the hollow parts 7 of the inclined members 2*a*, 2*a* on both sides and is discharged into atmosphere through the rear opening.

Reference numerals 52 and 53 denote a pair of rotary impeller units mounted on both sides of the centre of the third unit molding cross-bar $17_3$. Each of the rotary impeller units 52, 53 comprises a hub or boss 55 fitted to or fixedly secured to a rotary shaft 54, said hub 55 having a plurality of radially extending vanes or blades 56 fixedly secured thereto. The rotary shafts 54, 54 can be rotated reversely through a transmission mechanism 57 by a hydraulic motor 58. Stated in brief, gears 62 secured to the rotary shafts 54 are toothed indirectly with each other through a gear 60 secured to an output shaft 59 of the hydraulic motor 58 and intermediate gears 61 engaged therewith.

Reference numeral 63 denotes a front cover plate hanging from and fixedly secured to the above-mentioned transverse bar 36. A "V"-shaped guide member 64 is fixedly secured to the central part of the front cover plate 63 above the above-mentioned pair of impeller units 52 and 53. The pair of impeller units 52 and 53 and the guide member 64 constitute a paving material scattering mechanism 66 arranged to guide the paving material splashed by the impeller units so as to fly towards both sides thereof.

The operation of the apparatus according to the present invention will now be described below.

The water channel forming apparatus is suspended and positioned by means of a crane etc. within the water channel which has previously been excavated by a motor grader etc.

In this case, the water channel forming apparatus is supported within the water channel by the pair of bodies 1, 1 and lower end faces 29*a* of the longitudinal plates 29 for mounting the extrusion molding screw conveyors 27.

In the next place, a paving material such as asphalt etc. is discharged into the water channel being built by means of a shovel bulldozer.

After that, the motors 32 and the motor 58 are driven so as to actuate the extrusion molding screw conveyors 27 and the rotary impeller units 52 and 53.

The paving material dumped into the water channel is lifted and discharged by the impeller units 52 and 53 and is guided by the guide member 65 to scatter or fly sidewise or towards the inclined inner wall surfaces "a" on both sides of the water channel being built.

The paving material scattered sidewise is pushed and compacted or consolidated between the inclined members 2*a* of the molding member 2 and the inclined inner wall surfaces "a" on both sides of the water channel and also between the central horizontal member 2*b* and the inner wall surface "b" of the horizontal bottom thereof.

When the paving material is sent under pressure into the above-mentioned spaces and compacted further, a reaction force is generated which allows the entire water channel forming apparatus to float off and move forwards so that the paving material can be laid continuously on the inclined inner wall surfaces "a" on both sides of the water channel being built and the inner wall surface "b" of the horizontal bottom thereof.

Further, at the beginning of the drive, it is necessary to supply the paving material in front of the rotary impeller units 52 and 53.

In the illustrated embodiment, the respective hydraulic motors 32 of the extrusion molding screw conveyors 27 are connected with the hydraulic pump 40 through their respective hydraulic circuits arranged in parallel and connected to one another so that the screw conveyors are rotated with receiving a uniform torque from their respective hydraulic motor 32 in case that paving material is continuously supplied under the molding member 3 without occurring a shortage thereof anywhere. However, if the uniform load is not applied on at least one of the screw conveyors 27 due to the occurrence of a shortage of paving material about at least one of screw conveyors 27, the hydraulic motor 32 associated with the less loaded screw conveyor 27 is idly rotated. As a result, fluid pressure within the hydraulic circuits is reduced so that any one of other hydraulic motors 32 can not create a torque sufficient to rotate the screw conveyor 27 associated therewith. Therefore, the whole channel forming apparatus cannot be moved ahead.

Further, since the exhaust gas from the engine 39 passes through the hollow parts 7 of the molding member 2 and then discharged into atomosphere so that the molding member 2 can be heated by the exhaust gas, the molding member 2 can be slid smoothly on the paving material, and therefore the surface of the paving material laid on the trench can be smoothly finished.

Further, since the first, second and third unit mounting cross-bars $17_1$, $17_2$ and $17_3$ are connected through the spacers 18 by means of bolts, the shape of the mounting cross-bar 3 can be changed by changing the shape of spacers 18. Therefore, the water channel forming apparatus can be applied to the formation of water channels of various sectional shapes, and also the dimension of the mounting cross-bar 3 can be altered by increasing or decreasing the number of the unit mounting cross-bars $17_1$, $17_2$ and $17_3$ so that the water channel forming apparatus can be used for the formation of water channels of various sizes.

Figure 6:
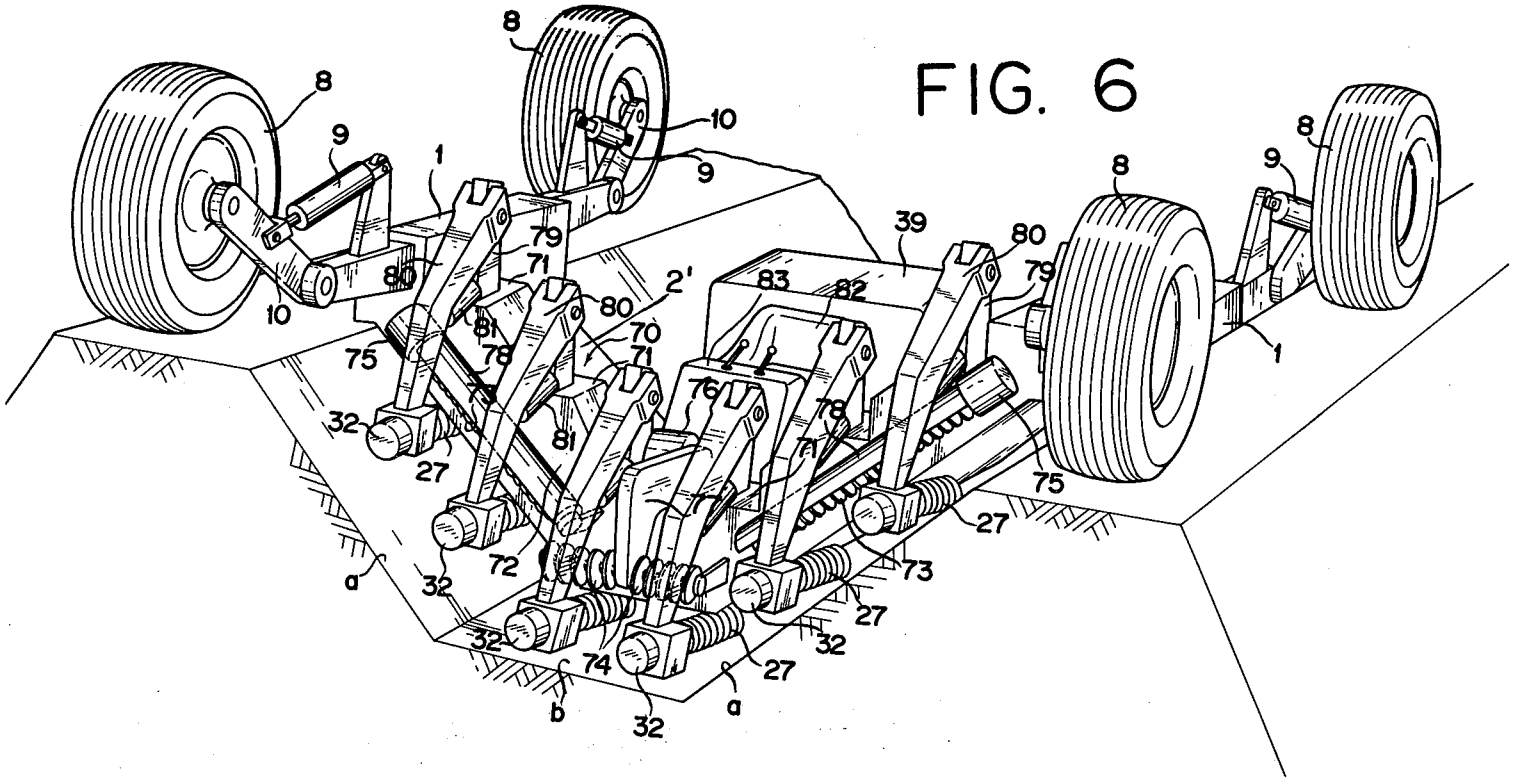
FIG. 6 is a perspective view of another embodiment of the present invention.

FIG. 6 shows another embodiment of the present invention which differs most from the aforementioned embodiment in that screw conveyors are employed for scattering the paving material uniformly in place of the paving material scattering mechanism 66 of the previous embodiment comprising the rotary impeller units 52 and 53 and the guide member 64.

Riding and fixedly secured to a pair of bodies 1, 1 are a molding member 2' and mounting cross-bars 70 formed as an integral part thereof. The construction of the molding member 2' is similar to that of the first embodiment, and so the explanation of it will be omitted herein. Each of the mounting cross-bars 70 has an upper wall 71 which becomes gradually low, and is of a box-like sectional shape. Mounted on the front wall 72 of the mounting cross-bar 70 are screw conveyors 73, 73 installed approximately parallel with the inclined inner wall faces "a" on both sides of the water channel, and central screw conveyors 74, 74 installed in approximately parallel with the inner wall surface "b" of the horizontal bottom of the water channel, said screw conveyors 73, 73 and 74, 74 being operatively connected. The screw conveyors 73 are driven or rotated by hydraulic motors 75 mounted on the front wall 72 of the mounting cross-bar 70, whilst the central screw conveyors 74 are driven or rotated through a transmission mechanism 77 by a hydraulic motor 76 mounted on the central upper wall 71 of the mounting cross-bar 70. A trough 78 is installed above each of the sideways transfer screw conveyors 73 for preventing the scattering of the paving material. Reference numeral 27 denotes a plurality of extrusion molding screw conveyors in spaced relationship in the transverse and longitudinal directions and along the molding member 2'. The leading edge of each of the extrusion molding screw conveyors 27 is located opposite to the front inlet of the molding member 2'.

Each of the extrusion molding screw conveyors 27 is fixedly secured to one of oscillatory levers 80 carried by brackets 79 secured to the upper wall 71 of the mounting cross-bar 70, and is adapted to be driven by a respective hydraulic motor 32. The lever 80 is arranged to be oscillated by the action of a hydraulic cylinder 81. Reference numeral 39 denotes an engine, the exhaust pipe of which is connected to the hollow parts of the molding member 2' (not shown). Reference numerals 82 and 83 indicate a driver's cab and a manipulator member, respectively.

In operation of the apparatus according to this embodiment, after a paving material such as asphalt or the like has been placed onto the previously excavated water channel, the hydraulic motors 75, 76 and 32 are driven to actuate the paving material transfer screw conveyors 73 and 74 and the extrusion molding screw conveyors 27. As a result, the paving material dumped into the water channel is conveyed by the paving material transfer screw conveyors 73 and 74 sideways and along the inclined inner wall surfaces "a" on both sides of the channel and is laid uniformly. The other operation is almost similar to that of the first embodiment in that the paving material is compacted or consolidated between the molding member 2' and the water channel and the reaction force created by the compaction allows the entire water channel forming apparatus to float off and move forwards.

Figure 7:
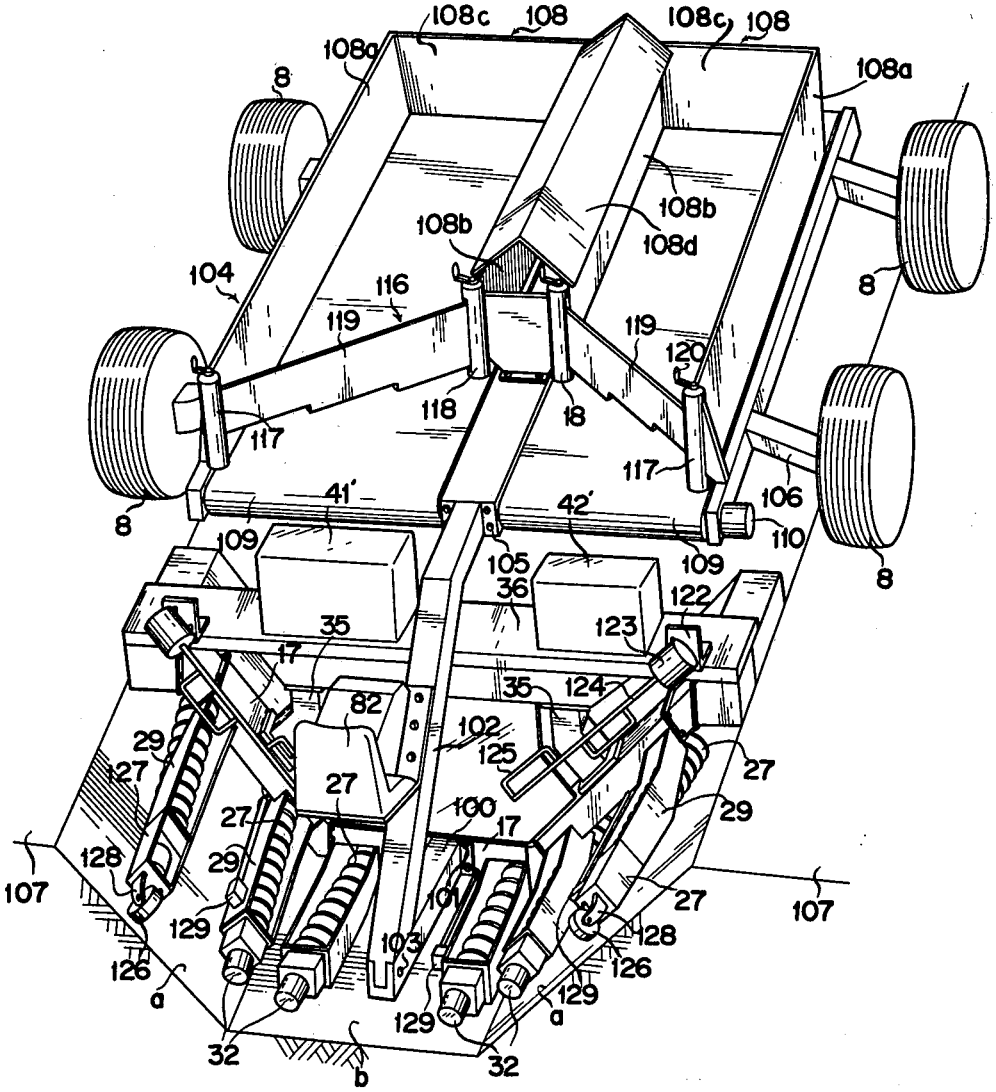
FIG. 7 is a perspective view of still another embodiment of the present invention.
Figure 8:
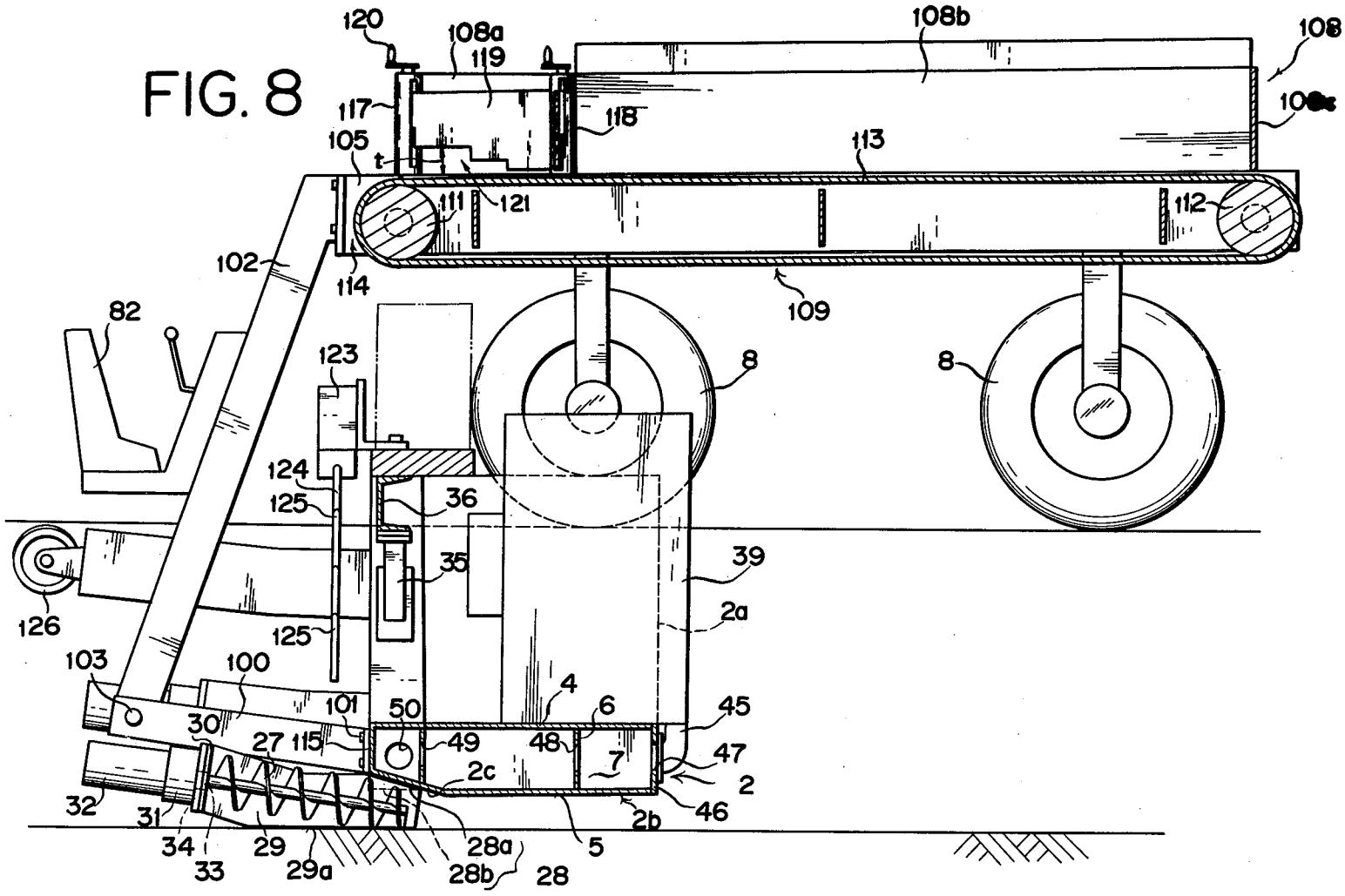
FIG. 8 is a cross-sectional side view of FIG. 7.

FIG. 7 shows a still further embodiment of the present invention which differs from the aforementioned two embodiments in that it comprises a paving material container mounted above the water channel forming apparatus for continuously supplying the paving material in place of previously laying the paving material at a predetermined spacing in front of the water channel forming apparatus installed in the water channel under construction.

At the center of the front face of the unit mounting cross-bar 17, a first frame 100 extends forwardly and is fixedly secured thereto by means of bolts 101. A second frame 102 is pivotally connected to the leading end of the first frame 100 by means of a pin 103 so that the second frame can be turned freely in the direction of movements. The second frame 102 extends obliquely and upwardly and is fixedly secured to the central, front part of main frame 105 of a truck 104.

The truck 104 is provided with wheels 8 mounted through respective arms 106 on both sides of the main frame 105. The wheels 8 are kept in contact with banks 107, 107 on both sides of the water channel and the truck 104 is supported so that it can run freely while stiriding the water channel under construction.

Mounted on the above-mentioned main frame 105 are a pair of hoppers 108, 108 each having a lower opening. Installed under the openings of the hoppers 108 are a pair of longitudinally extending conveyors 109. Each of the conveyors 109 comprises an endless belt 113 engaged with a driver wheel 111 adapted to be driven by a hydraulic motor 110 and an idle wheel 112. The front end exit 114 of each of the conveyors 109 is located slightly ahead the front face 115 of the above-mentioned cross-bar 5.

Further, each of the hoppers 108 has a front opening formed by outer side frames **108*a*, inner side frames 108*b* each being shorter than the outer side frame 108*a* with respect to its longitudinal direction, and each front opening has a gate mechanism 116. Stated more specifically, in each hopper 108, a first guide member 117 is fixedly secured at the front end of the outer side frame 108*a*, and a second guide member 118 is fixedly secured at the front end of the inner side frame 108*b* and rearwardly as compared with the first guide member. A gate 119 extends aslant and is vertically slidably inserted between the first and second guide members 117 and 118. Each of the first and second guide members 117 and 118 is provided with a handle for the vertical slide of the gate 119. The lower end face of each of the gates 119 is cut stepwise so as to form a stepped part 121. The clearance "t" between the lower end face of the gate 119 and the upper surface of the conveyor 109 is formed so as to become wider towards the first guide member 117. An angle-shaped plate 108*d* is fixedly secured to the inner side frames 108*b*, 108*b* so as to connect the hoppers 108, 108** on the left and right sides.

Further, hydraulic motors 123 are fixedly secured, respectively, through a bracket 122 to both sides of the aforementioned transverse member or cross-bar 36. Each of the hydraulic motor 123 has an output shaft or rotary shaft 124 extending in parallel relationship with the first and second unit mounting cross-bars $17_1$ and $17_2$ and downwardly along the inclined inner wall surfaces "a" on both sides of the water channel being built. Each of the rotary shafts 124 has a pair of U-shaped blades 125 secured thereto at a position opposite to each one of extrusion molding screw conveyors 27 and out of phase of 180 degrees relative thereto. When the rotary shaft 124 is rotated by the hydraulic motor 123, the pair of U-shaped blades 125 will rotate so as to agitate the paving material dumped from the conveyor 109 thereby preventing the paving material from being molded in the shape of a bridge. Reference numeral 82 denotes a driver's cab secured to the second frame 102.

The extrusion molding screw conveyors 27 mounted opposite to the inclined inner wall surfaces "a", "a" on both sides of the water channel being built are each provided with a steering wheel 126 arranged to contact with said surfaces "a", "a", respectively. In brief, a U-shaped bracket 127 is fixedly secured to a cover plate 30 so as to surround a reduction gear 31 and a motor 32, and the bracket 127 has a steering wheel 126 mounted thereon through a mounting arm 128.

Further, every other screw conveyor 27 has a vibration generator 129 mounted on the longitudinal plate 29 thereof in the axial direction of the screw conveyors 27 for the purpose of achieving consolidated settlement of the paving material.

In the next place, the operation of the apparatus according to this embodiment will now be described below.

The water channel forming apparatus according to the present invention is suspended and located by means of a crane etc. within the water channel which has previously been excavated by a motor grader etc.

In this case, the water channel forming apparatus is held on the inclined inner wall surfaces "a", "a" on both sides of the water channel and the inner wall face "b" of the horizontal bottom thereof by a pair of bodies 1, 1 and the lower end faces **29*a* of the longitudinal plates 29 for mounting the extrusion molding screw conveyors 27**.

Next, the paving material is charged into the hoppers 108 and the conveyors 109 are driven so as to convey the paving material within the hoppers 108 forwardly thereby allowing the paving material to dump through the clearance "t" between the gates 119 and the conveyor surfaces.

At that time, because the gates 119 are inclined relative with respect to the transverse direction of respective hoppers 108 and the clearance "t" is formed so as to become wider towards the first gate member 117 positioned by the outer side frame **198*a*, most of the paving material will drop from the sides of the gates 119** towards the inclined inner wall surfaces "a", "a" on both sides of the water channel. The paving material thus dropped will gradually flow down along the inclined inner wall surfaces "a", "a" towards the inner wall face "b" of the horizontal bottom thereof.

Therefore, the paving material can be supplied uniformly on the inclined inner wall surfaces "a", "a" on both sides of the water channel being built and the inner wall surface "b" of the bottom thereof.

At the same time, the hydraulic motors 32 are driven so as to actuate the extrusion molding screw conveyors 27 so that the paving material can be sent under pressure by the screw conveyors 27 between the inclined members **2*a* of the molding member 2 and the inclined inner wall surfaces "a", "a" on both sides of the water channel and also between the central horizontal member 2*b*** and the inner wall surface "b" of the horizontal bottom of the water channel being built, and is therefore compacted densely therebetween.

When the paving material is charged under pressure into such spaces and consolidated further, a reaction force is produced which allows the entire water channel forming apparatus to float off and move forwards, and the truck 104 is moved forwards through the first and second frames 100 and 102 so that the paving material can be laid continuously on the inclined inner wall surfaces "a", "a" on both sides of the water channel being built and the inner wall surface "b" of the horizontal bottom thereof.

In the illustrated embodiment, the hydraulic motors 32 of the extrusion molding screw conveyors 27 are connected in parallel arrangements with a hydraulic fluid supply source, and therefore if a uniform loading is not applied to the extrusion molding screw conveyors 27, the entire water channel forming apparatus cannot be moved forwards. In other words, if the load applied on one of the screw conveyors is reduced, the hydraulic motor 32 associated therewith will run idly.

Further, since the exhaust gas emitted by the engine 39 passes through the hollow parts 7 of the molding member 2 and is discharged to atmosphere so that the molding member 2 can be heated by the exhaust gas, the molding member 2 can be slidden smoothly on the paving material thereby enabling the surface of the thus laid paving material to be finished smoothly.

Further, since the first, second and third unit mounting cross-bars $17_1$, $17_2$ and $17_3$ are interconnected through the spacers $18_1$ and $18_2$ by means of bolts, the shape of the mounting cross-bar 3 can be changed by changing the shape of the spacers $18_1$ and $18_2$ so that the channel forming apparatus can be used for forming water channels of various sectional shapes, and also the size of the mounting cross-bar 3 can be changed by increasing the number of the unit mounting cross-bars $17_1$, $17_2$ and $17_3$ so that the channel forming apparatus can be employed for the formation of water channels of various sizes.

Furthermore, since each of the gates 119 can be raised and lowered by turning a handle 120 associated with it, the clearance "t" between the lower end face of the gate 119 and the conveying surface of the conveyor 109 can be adjusted as desired.

For this reason, the amount of the paving material to dump into the water channel under construction can be adjusted as desired.

Further, since the paving material is agitated by the vanes or blades 125 during the course of dropping, the paving material can be prevented from being formed into the shape of a bridge and can be laid satisfactorily on the surface of the water channel being built.

Still further, each of the pair of extrusion molding screw conveyors 27, 27 on the left and right sides is provided with a steering wheel 126, and therefore when the water channel forming apparatus is moved forwards and backwards, the steering wheels 126 are permitted to rotate on the inclined inner wall surfaces "a", "a" on both sides of the channel so as to act as a guide means.

Therefore, even in the case the water channel is curved, concave, convex or meandering, an increase of moving resistance due to interference of the lower surface of the molding member and the lower surfaces 29*a* of the mounting longitudinal plates 29 with the inner wall faces "a" and "b" of the water channel being built so that the water channel forming apparatus can be ensured to move by the reaction force created by supplying the paving material under pressure.

Further, because the first frame 100 and the second frame 102 are pivotally connected by means of the pin 103 so that they can be turned in the direction of movements, the molding member 2, the mounting cross-bar 3 and the truck 104 can be oscillated to one another in the direction of movements thereof.

Therefore, even in the case the inner wall surfaces "a" and "b" of the water channel are irregular or uneven, the molding member 2 and the mounting cross-bar 3 can be oscillated or shifted vertically relative to the truck 104.

Figure 9:
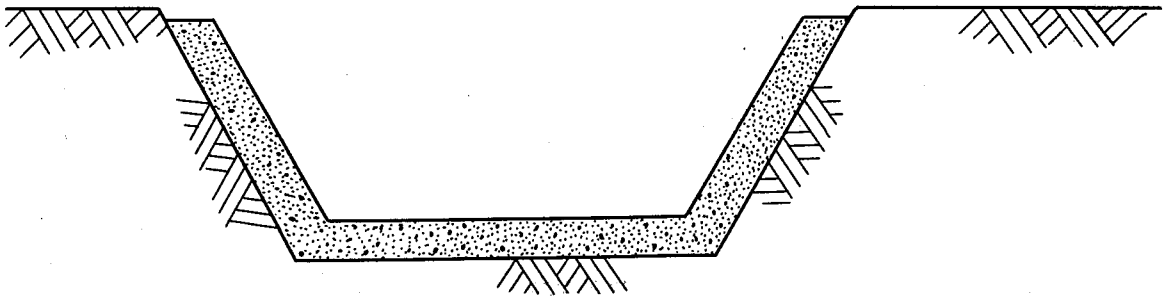
FIG. 9 is a cross-sectional view of a water channel produced by employing an apparatus of the present invention.

Furthermore, since the longitudinal plates 29 of the screw conveyors 27 have vibration generating means mounted thereon in alternating arrangement, the paving material supplied by the hoppers 108 can be compacted or consolidated densely so that the water channel having a uniform layer of paving material laid thereon as shown in FIG. 9 can be constructed.

Although the first and second embodiments are shown without having vibration generating means, the vibration generating means can of course be attached to the apparatuses according to these embodiments.

It is to be understood that the above description is by way of example only, and that details for carrying the invention into effect may be varied without departing from the scope of the invention claimed.

What is claimed is:

1. A paving material extrusion molding apparatus adapted for laying a paving material of a predetermined thickness on the surface of a trench which has previously been excavated under the ground, comprising: (a) a body formed by a pair of parallel frames and a stand extending on and carried by the frames; (b) power generating means mounted on said body; (c) molding means having a predetermined shape, said predetermined shape being similar to that of said excavated trench and being mounted at a predetermined spaced interval therefrom on the lower part of said body; (d) a plurality of paving material conveyor means mounted in the front of said molding means; and (e) a paving material lifting means mounted in the front and lower part of the molding means and in the approximately central part of the extrusion molding apparatus so that paving material piled on a central horizontal part of the excavated trench can be raised up on inclined parts formed on both sides of the trench thereby enabling the paving material to be scattered uniformly.

2. A paving material extrusion molding apparatus as claimed in claim 1, wherein said molding means and at least one of said plurality of paving material conveyor means are assembled in units so that these units can be combined so as to form a sectional shape corresponding to that of the excavated trench.

3. A paving material extrusion molding apparatus as claimed in claim 1, wherein several of the plurality of paving material conveyor means are installed in parallel with one another in the direction of laying of the paving material, and the reaction force created by sending the paving material under pressure within the molding means by the conveyor means serves to propel the entire molding apparatus.

4. A paving material extrusion molding apparatus as claimed in claim 1, further comprising wheels mounted on the sides of the body for enabling the molding apparatus to run in the direction of laying of the paving material, said wheels being mounted on said body through a linkage mechanism so that the wheels can be raised and lowered by means of a hydraulically operated actuator.

5. A paving material extrusion molding apparatus as claimed in claim 1, wherein said paving material lifting means comprises at least two sets of rotary impeller units arranged to engage with one other and rotate synchronously so as to raise up the paving material in opposite directions.

6. A paving material extrusion molding apparatus as claimed in claim 1, wherein said paving material lifting means are mounted transversely in the direction along the sectional shape of the excavated trench and above the plurality of conveyor means and comprise a plurality of screw conveyors adapted to be driven by motors.

7. A paving material extrusion molding apparatus as claimed in claim 1, further comprising a driver's cab mounted on the upper part of the body, said driver's cab including a control system centralized therein.

8. A paving material extrusion molding apparatus adapted for laying a paving material of a predetermined thickness on the surface of a trench which has previously been excavated under the ground, comprising: (a) a body formed by a pair of parallel frames and a stand extending on and carried by the frames; (b) power generating means mounted on said body; (c) molding means having a predetermined shape, said predetermined shape being similar to that of said excavated trench and being mounted at a predetermined space interval therefrom on the lower part of said body; (d) a plurality of paving material conveyor means mounted in the front of said molding means; and (e) hopper means for distributing paving material uniformly on the upper surface of the conveyor means mounted in the front part of the molding means, wherein the bottom parts of said hopper means are formed by belt conveyors, and limiter plates are disposed between a loading part and a supplying part of the hopper means so that a predetermined or reuired amount of paving material can be supplied onto the conveyor means regardless of the shape of the paving material loaded or piled on the loading part of the hopper means.

9. A paving material extrusion molding apparatus as claimed in claim 8, further comprising a plurality of wheels mounted on both sides of said hopper means so that they can run or rotate in the direction of laying of the paving material.

10. A paving material extrusion molding apparatus as claimed in claim 8, further comprising a driver's cab mounted in the front part of the extruding molding apparatus, said driver's cab including a control system centralized therein.

11. A paving material extrusion molding apparatus as claimed in claim 8, wherein at least one set of vibration generating means is mounted on the extrusion molding apparatus so that an increased compaction or consolidation settlement effect can be obtained on the paving material laid on the surface of the trench.

12. A paving material extrusion molding apparatus as claimed in claim 8, wherein at least one of the plurality of conveyor means has a vibration generating means mounted thereon so that an increased compaction or consolidation settlement effect can be exerted on the paving material laid on the surface of the trench.

13. A paving material extrusion molding apparatus adapted for laying a paving material of a predetermined thickness on the surface of a trench which has previously been excavated under the ground, comprising: (a) a body formed by a pair of parallel frames and a stand extending on and carried by the frames; (b) power generating means mounted on said body; (c) molding means having a predetermined shape, said predetermined shape being similar to that of said excavated trench and being mounted at a predetermined space interval therefrom on the lower part of said body; (d) a plurality of paving material conveyor means mounted in the front of said molding means; and (e) arms rotatably mounted on linkage fixedly secured to a part of the body of the extrusion molding apparatus, said arms each having a conveyor means mounted thereon, each conveyor means being adapted to be turned and positioned by the action of a hydraulic actuator mounted between said fixed linkage and said arms.

* * * * *